United States Patent [19]

Rice

[11] 4,300,914

[45] Nov. 17, 1981

[54] METHOD AND APPARATUS FOR GASIFYING WITH A FLUIDIZED BED GASIFIER HAVING INTEGRATED PRETREATING FACILITIES

[75] Inventor: Louis F. Rice, Arcadia, Calif.

[73] Assignee: The United States of America as represented by the United States Department of Energy, Washington, D.C.

[21] Appl. No.: 132,357

[22] Filed: Mar. 20, 1980

[51] Int. Cl.[3] ..... C10J 3/68

[52] U.S. Cl. ..... 48/76; 48/63; 48/197 R; 48/206; 201/9; 201/31; 422/142

[58] Field of Search ..... 48/202, 203, 197 R, 48/210, 77, 63, 64, 76, 73; 201/9, 31; 422/142, 145, 193; 252/373

[56] References Cited

U.S. PATENT DOCUMENTS

| | | | |
|---|---|---|---|
| 2,579,398 | 12/1951 | Roetheli | 48/202 |
| 2,582,712 | 1/1952 | Howard | 201/31 |
| 2,588,075 | 3/1952 | Barr et al. | 48/206 |
| 3,463,623 | 8/1969 | Forney et al. | 48/202 |
| 3,481,834 | 12/1969 | Squires | 201/17 |
| 3,597,327 | 8/1971 | Squires | 201/12 |
| 3,752,658 | 8/1973 | Blaser | 48/206 |
| 3,867,110 | 2/1975 | Schora et al. | 48/210 |
| 3,884,649 | 5/1975 | Matthews | 48/202 |
| 3,945,809 | 3/1976 | Donath | 48/202 |
| 3,971,636 | 7/1976 | Matthews | 48/202 |
| 4,023,280 | 3/1977 | Schora et al. | 48/77 |
| 4,057,402 | 11/1977 | Patel et al. | 48/197 R |
| 4,060,397 | 11/1977 | Buiter et al. | 48/197 R |
| 4,064,018 | 12/1977 | Choi | 48/210 |

OTHER PUBLICATIONS

J. H. Perry, "Chemical Engineer's Handbook", 1974, pp. 20–49.

Patel, "Clean Fuel From Coal Is Goal of U-Gas Process", *Oil & Gas Journal*, Aug. 1, 1977.

Lewis, "Synthane Gasification Proves Responsive", *Oil & Gas Journal*, Aug. 1, 1977.

*Primary Examiner*—S. Leon Bashore
*Assistant Examiner*—Michael Goldman
*Attorney, Agent, or Firm*—Harold M. Dixon; Roger S. Gaither; Richard G. Besha

[57] ABSTRACT

An integral gasifier including a pretreater section and a gasifier section separated by a distribution grid is defined by a single vessel. The pretreater section pretreats coal or other carbon-containing material to be gasified to prevent caking and agglomeration of the coal in the gasifier. The level of the coal bed of the pretreater section and thus the holding or residence time in said bed is selectively regulated by the amount of pretreated coal which is lifted up a lift pipe into the gasifier section. Thus, the holding time in the pretreater section can be varied according to the amount of pretreat necessary for the particular coal to be gasified.

23 Claims, 1 Drawing Figure

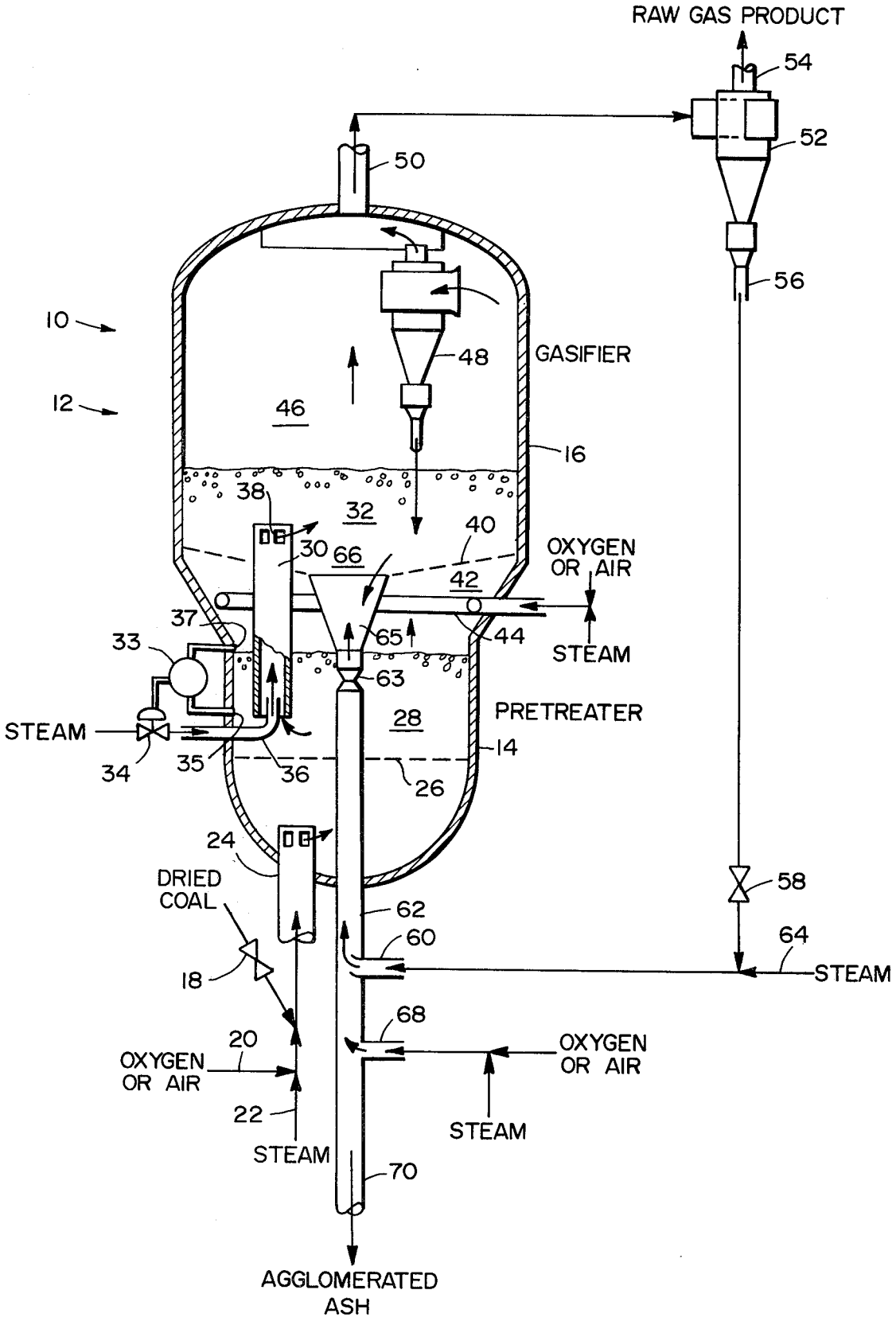
RAW GAS PRODUCT
54
52
50
56
10
12
48
GASIFIER
46
16
38
32
40
30
66
OXYGEN
OR AIR
42
37
33
65
44
STEAM
63
STEAM
28
PRETREATER
34
35
36
14
26
24
DRIED
COAL
58
62
60
64
STEAM
18
68
20
OXYGEN
OR AIR
OXYGEN
OR AIR
22
STEAM
STEAM
70
AGGLOMERATED
ASH

METHOD AND APPARATUS FOR GASIFYING WITH A FLUIDIZED BED GASIFIER HAVING INTEGRATED PRETREATING FACILITIES

BACKGROUND OF THE INVENTION

The invention described herein arose in the course of, or under, United States Department of Energy (formerly Energy Research and Development Administration) Contract Number EX-76-C-01-1775.

This invention relates to the production of nonpolluting fuels from coal and other carbonaceous solids. More specifically, it relates to the production of fuel gas from coal in a fluidized bed gasifier which includes an integral pretreatment stage.

BACKGROUND ART

There exist a class of coals which exhibit a property known as "caking." Such coals tend to soften and become somewhat sticky at relatively low temperatures. As these coals are heated in bed type gasifiers, having for example, fluidized, fixed or moving beds, there is a strong tendency for the coals to agglomerate and interfere with the orderly gasification process. Pretreating this class of coals with air or oxygen at a relatively low temperature, typically about 800° F. overcomes this agglomeration tendency.

Pretreatment has been practiced at both low and high pressure. The low pressure operation is at essentially atmospheric pressure. The offgas produced thereby has a low heating value and is produced at pressures suitable only for use as fuel to boilers or furnaces. Low pressure pretreaters are generally large and require a relatively long holding time.

Contrastingly, high pressure pretreaters, operate at essentially gasification pressures and provide a more useful, a higher heat value, offgas. The offgas of these pretreaters can be combined and used with gasifier product fuel gas. Using air to pretreat limits such systems to the manufacture of the low heating value gas. There is no such limitation if oxygen is used for both gasification and pretreatment.

One presently conceived pretreater utilizes oxygen and enough steam to assure fluidization of the pretreater bed. The offgas from the pretreater is conducted to the bottom of the gasifier bed and there joins the produced fuel gas. For this system coal or other carbonaceous solid is fed from for example, a standpipe and valve, a screw conveyor, or other mechanical flow regulating device, directly to the top of the pretreater bed. The treated coal overflows into a standpipe which includes a solid flow control device, and is injected into the gasifier at the top of the bed. Temperature control is achieved by coil heat exchangers immersed in the pretreater bed. This system is more fully disclosed in U.S. Pat. No. 4,057,402 issued on Nov. 8, 1977 to J. G. Patel, and in the article entitled "Clean Fuel From Coal is the Goal of U-Gas Process" by J. G. Patel, *The Oil and Gas Journal,* Aug. 1, 1977.

Another pretreater conception uses oxygen for pretreatment and sufficient steam to control the pretreater temperature and to convey the coal into the pretreater bed. Precontacting the coal with oxygen reduces the holding time needed in the coal bed of the pretreater. Both offgas and treated coal overflow together into the gasifier bed. An example of this system can be seen in an article entited "Synthane Gasification Proves Responsive" by Robert Lewis in *The Oil and Gas Journal,* Aug. 1, 1977.

Problems and disadvantages associated with the above and other prior art devices include the following. First, most systems are comprised of several separate subsystems such a separate pretreaters and separate gasifiers. Consequently complex and costly conduits must be designed into the system to transfer offgases and coal between the subsystems.

Second, where the transfer of coal between the pretreaters and gasifiers is accomplished by the overflow of pretreated coal from the pretreater bed into a conduit, there is no mechanism for controlling the residence time of the coal in the pretreater bed by varying the bed level and thus, the system cannot be adjusted for optimum operations.

Third, many existing systems use cooling coils located in the pretreater to control the temperature of the pretreater. Such an arrangement introduces undesirable thermal inefficiencies into the system.

Fourth, some of the prior art systems do not provide for good mixing of newly introduced offgases and pretreated coal with the char in the gasifier.

Accordingly, an object of the present invention is to provide a unitary, integral system which incorporates a pretreater and a gasifier with a minimum of piping and conduits.

Another object of the present invention is to provide for the selective control of the coal bed level in the pretreater, hence the residence time of the coal in the pretreater, to optimally operate the pretreater and gasifier.

Yet another object is to efficiently cool the pretreater to control the temperature thereof.

Still another object is to provide for good mixing of introduced offgas and coal from the pretreater with the char in the gasifier.

Another object is to agglomerate ash in the gasifier section to efficiently remove ash therefrom.

SUMMARY OF THE INVENTION

The present invention is directed to overcoming one of more of the problems as set forth above. The invention meets all the above objects and efficiently processes "caking" coal.

The invention includes a gasifier and gasification method for producing a gaseous product from a carbonaceous or carbon-containing solid. The gasifier has a pretreater section and means for introducing the carbonaceous solid into the pretreater section. Further means are provided for introducing an oxygen-containing as into the pretreater section to fluidize and pretreat the carbonaceous solid in said pretreater section. The invention further includes a gasifier section located above the pretreater section and means for introducing offgas produced in the pretreater section into the gasifier section. Further means are included for introducing the pretreated carbonaceous solid from the pretreater section to the gasifier section which includes at least one lift pipe extending from the bed of carbonaceous solid in said pretreater section into said gasifier section. The invention further includes means for regulating the rate of flow of the carbonaceous solid through the lift pipe into the gasifier section in order to control the residence time of the carbonaceous solid in the pretreater section and to optimize the operation of the pretreater section.

An aspect of the invention includes means for creating a higher temperature zone in said gasifier sections to soften and agglomerate ash produced therein.

Another aspect of the invention includes the gasifier section and the pretreater section defined by a single vessel and wherein the gasifier section is located above the pretreater section and is separated therefrom by a grid which allows offgas from the pretreater section to directly and uniformly be introduced at the bottom of the gasifier bed. Such an arrangement reduces interconnecting piping and conduits between the gasifier section and the pretreater section.

Another aspect of the invention is that a large portion of the gasification process steam is passed through the pretreater section. The steam helps fluidize the coal bed of the pretreater and serves as the primary pretreating temperature control, thereby eliminating the need to have inefficient cooling coils in the pretreater section.

The method includes the steps of introducing carbon-containing solid into a pretreater section of a gasifier and introducing oxygen-containing as into the pretreater section to pretreat the carbon-containing solid. Further, the method includes the steps of introducing pretreated carbon-containing solid from the pretreater section into the gasifier section and regulating the rate of flow of the carbon-containing solid from the pretreater section into the gasifier section in order to selectively control the residence time of the carbon-containing solid in the pretreater section.

BRIEF DESCRIPTION OF THE DRAWING

The FIGURE is a partially sectioned side elevational view of the gasifier of the invention.

DETAILED DESCRIPTION OF THE PREFERRED EMBODIMENT

With reference to the FIGURE, a gasifier is depicted and identified by the numeral 10. Gasifier 10 includes a unitary pressure vessel 12 which is comprised of material that can withstand gasifier pressure, temperature, and inherently corrosive elements, and can include for example, steel suitably lined with an insulating material. Vessel 12 includes a lower pretreater section 14 and an upper gasifier section 16.

Dried coal or other carbon-containing solid enters gasifier 10 through a flow regulating valve 18. A rotating feeder or other mechanical feed device could be substituted for valve 18. The coal is then contacted with preheated oxygen, and/or other oxygen-containing as provided in conduit 20 in sufficient quantity to accomplish the desired degree of pretreat. In a preferred embodiment, the oxygen flow, for example, is presumed to be on the order of about one standard cubic foot per pound of ash-free dry coal, and at a temperature of 600° F. Sufficient superheated steam is also added through conduit 22 to aid in conveying the coal upward in a relatively dispersed phase in inlet lift pipe 24 and to cool the pretreater section 14. This steam quantity can be varied to maintain the desired pretreating temperature of 800° F., for example, in a preferred embodiment. Saturated steam is mixed with superheated steam so that the cooling demands of pretreater section 14 are not permitted to override the total steam needs of the gasifier section 16. The stream of coal, oxygen and steam is delivered to the lower portions of the pretreater section 14 through openings at the top of lift pipe 24. The coal, oxygen and steam are distributed more or less uniformly across the pretreater section 14 by means of a plate grid 26 or other suitable distributing device. The grid 26 allows the coal and gas flow to pass therethrough and also services to support the pretreater bed of coal 28. The upwardly-passing oxygen and steam maintains bed 28 in a fluidized state.

The level of pretreater bed 28 is maintained by regulating the rate of pretreated coal outflow therefrom. The level is variable to provide up to, for example, in a preferred embodiment, about five minutes holding time for the coal in the pretreater section 14. Outflow is through one or more lift pipes such as lift pipe 30 which convey the treated coal into the gasifier bed 32. The lift gas, in a preferred embodiment, is superheated gasification process steam provided to lift pipe 30 by outflow or bed level controller 33 which adjusts regulator 34 to control the amount of steam directed by conduit 36 into lift pipe 30. The steam fluidizes and decreases the bulk density of the column of treated coal within the lift pipe 30. Discharge openings 38 of the lift pipe 30 are located above a sloping gasifier distribution grid 40 which separates the gasifier section 16 from the pretreater section 14, supports gasifier bed 32 and allows pretreater offgas to pass therethrough. To induce pretreated coal upflow in a lift pipe 30, the static head in lift pipe 30 must be a little less than the pressure drop through the gasifier distribution grid 40. This is accomplished as explained below by fluidizing the solids in lift pipe 30 with said steam through regulator 34, causing the greater pressure in freeboard 42 of pretreater section 14 to force coal up lift pipe 30.

Level controller 33 senses the pressure in bed 28 at point 35 and the pressure above bed 28 in free board 42 at point 37. The differential pressure measured gives an indication of the level of bed 28. As the level of bed 28 increases due to a greater flow of coal into bed 28 from lift pipe 24 than out of bed 28 through lift pipe 30, the pressure head at piont 35 increases due to the increased depth of the fluidized coal, which acts much like a liquid, in bed 28. The differential pressure increases and accordingly the level controller 33 resets regulator 34 to allow more steam to enter lift pipe 30, decreasing the density in lift pipe 30 and causing more pretreated coal to flow into lift pipe 30 and be lifted to gasifier section 16. The level of bed 28 is thereby lowered to a desired level, decreasing the residence time of the coal in bed 28. Conversely if, the level of bed 28 is too low, level controller 33 can decrease the flow rate of the steam through regulator 34 thereby increasing the density of coal in lift pipe 30, decreasing the flow rate therethrough. Accordingly, the level of bed 28 is increased and the coal residence time in bed 28 is increased. To vary pretreatment holding time, the level of the bed in pretreater section 14 can be changed by adjusting level controller 33. Further the coal inventory in bed 28 can also be adjusted by regulating the feed through lift pipe 24 with regulators (not shown). It is to be understood that other means beside measuring differential pressure can be used to determine the level of bed 28 and to adjust the amount of steam delivered to lift pipe 30.

In a preferred embodiment, for example, flow is established when the pretreated coal density in lift pipe 30 is lowered to about 21–22 lbs/cu. ft. from approximately 24 lbs/cu. ft. in the pretreater bed 28. A small but finite amount of steam is required to bring about this fluidized density reduction. Also, other gases, such as recycled gasifier product gas, or inert gas, or other mixtures can be employed in the pretreated coal lift 30 instead of steam as indicated above.

As is evident from the foregoing, the offgas and the pretreated coal proceed separately from pretreater section 14 through grid 40 to gasifier section 16, and that in a preferred embodiment the pressure in the pretreater section 14 is not less than the pressure in the gasifier section 16.

Oxygen, air or other oxygen-containing gas for gasification is provided through a distributor 44 located below grid 40 and passes with said offgas through gasifier grid 40 to fluidize gasifier bed 32. When needed, additional gasification process steam can also be injected through distributor 44.

It is to be understood that the oxygen or oxygen-containing gas and the steam could alternatively be sparged directly into the gasifier bed 32 without affecting the spirit of the invention.

After gasification occurs in the gasifier section 16, raw product gas emerges from the fluidized gasifier bed 32 and passes upward through the gasifier section foreboard 46. The free board 46 allows the bulk of the char produced in the gasifier section 16 which is lifted from gasifier bed 32 by the production gas, to settle back into bed 32. The lighter and finer particles of char will be carried through the free board 46.

Located at the upper end of vessel 12 above gasifier bed 32 is a first stage cyclone 48. Then processing coals of low reactivity requiring prolonged processing time to gasify, the first stage cyclone 48 recovers the bulk of the char entrained through the freeboard 46 for recycling back into the bed 32 for further gasification.

The raw product gas leaves vessel 12 through conduit 50 and still contains some char fines. These char fines will be largely collected in the second stage char fines cyclone 52. From cyclone 52 the raw gas flows through conduit 54 to be processed in additional equipment (not shown) for heat recovery, final dust cleanup and acid gas removal. The char fines collected by cyclone 52 are delivered to a standpipe 56. The fines accumulate in standpipe 56 in order to buildup a sufficient static head of pressure to allow them to pass through a control valve 58 or other appropriate flow regulating device and be reinjected through conduit 60 and riser 62 into the gasifier section 16 to supply additional fuel. Superheated process steam introduced to conduit 60 at point 64 is used to convey the recovered char fines through conduit 60 and up riser 62.

In gasifier section 16, a high temperature zone 66 is provided to soften ash produced therein so that the ash particles become sticky and agglomerate on colliding. Zone 66 is located on or near center line of vessel 12 and above the low point of conically shaped gasifier grid 40. To achieve this high temperature zone 66, a stream of oxygen, air or other oxygen-containing as is injected into riser 62 through conduit 68. Additionally, steam can be introduced into conduit 68 to dilute the oxygen. Further as can be seen in the FIGURE, riser 62 terminates in a venturi choke 63 and an acutely angled cone 65 which is located immediately below high temperature zone 66.

Ash particles migrate by gravity down the gasifier grid 40 to the high temperature zone 66. Once there, the particles get caught up in a combustion plume and heat up to the ash softening point. Collisions are frequently due to turbulence in zone 66 and the agglomerating particles grow rapidly. As they grow, the particles slip down into the cone 65 with growth continuing until sufficient mass is acquired to allow the agglomerated ash lumps to fall through the venturi 63 against the upflowing gases. It is to be understood that as venturi 63 increases the speed of the gases flowing through riser 62, venturi 63 insures that the agglomerated ash lumps are of a certain size before they can drop therethrough. The agglomerates fall out the bottom end 70 of the riser 62 and into appropriate disposal facilities (not shown). The disposal facilities may be dry, as in the case of lockhoppers, or wet, as in the case of a slurrying tank.

While the operation of the gasifier 10 is set out above, the following should be kept in mind.

First, by controlling the rate of flow of pretreated coal through lift pipe 30, the level of fluidized pretreat bed 28 can be varied independently to provide optimum holding time in the pretreater section 14.

Second, the pretreater section 14 is cooled efficiently without the use of cooling coils by the process gasification steam passing through lift pipe 24. The pretreater section 14 can include additional cooling means (not shown) if the pretreatment needs of a particular coal require more cooling than can be conveniently obtained from the process gasification steam passing through lift pipe 24. Such cooling then can be obtained by injecting condensate directly into bed 28.

Third, as gasifier 10 includes both pretreater section 14 and gasifier section 16 in a unitary vessel 12, there is a minimum of simple conduits to transfer offgas and pretreated coal from pretreater to gasifier.

Fourth, there is good mixing of the offgas and pretreated coal with the coal in gasifier section 16 as the offgas is introduced through grid 40 and the pretreated coal through lift pipe 30 at the bottom of gasifier bed 32.

Fifth, although the beds 28 and 32 have been described as fluidized, it is to be understood that other types of beds, such as, for example, a fully entrained bed can be used in gasifier section 16.

Further, as indicated above, it is possible to substitute air for oxygen in either the gasifier section 16 or the pretreater section 14 and to use product fuel gas instead of steam in lift pipe 30 to cause pretreated coal to enter gasifier section 16. Similarly, the char fines from cyclone 52 to be conveyed by product gas, inert gas, or oxygen, in addition to the steam introduced at point 64.

Also there are no known operating pressure limitations to this apparatus. The apparatus can be designed for any pressure from nearly atmospheric to at least 100 or more atmospheres. The actual working pressure is determined by the particular use to be made of the fuel gas. And the apparatus can be used without limitation to any particular gasification process. Thus, for example, BIGAS, HYGAS, SYNTHANE, U-GAS or other similar fuel gas can be produced. Additionally, the gasifier can be used to produce the other products besides the above fuel gas. Such products can include ammonia, methanol, hydrocarbon liquids and others.

Other aspects, objects, and advantages of this invention can be obtained from a study of the drawings, the disclosure, and the appended claims.

I claim:

1. A single vessel gasifier for gasifying carbon-containing solid comprising:

pretreater section and a gasifier section wherein said gasifier section is arranged substantially vertically over said pretreater section;

a grid means between said pretreater section and said gasifier section;

means for introducing carbon-containing solid into the pretreater section;

means for introducing an oxygen-containing gas into the pretreater section to pretreat carbon-containing solid in said pretreater section;

means for introducing pretreated carbon-containing solid from the pretreater section into the gasifier section;

wherein said means for introducing pretreated carbon-containing solid includes at least one substantially vertical lift pipe which is located within said single vessel gasifier and which extends from the bed of solids in said pretreater section into said gasifier section;

means for regulating the rate of flow of the carbon-containing solid through said lift pipe into the gasifier section in order to selectively control the residence time of carbon-containing solid in the pretreater section.

2. The apparatus of claim 1 wherein said means for introducing pretreated carbon-containing solid into the gasifier section comprises means for introducing a lift gas into said lift pipe to push carbon-containing solid up said lift pipe into said gasifier and means for regulating the flow rate of said lift gas.

3. The apparatus of claim 1 comprising means for selectively introducing steam into the pretreater section to cool carbon-containing solid in said pretreater section.

4. The apparatus of claim 1 wherein said grid is selective for passage of gases upwards between said preheater and said gasifier sections, wherein said lift pipe introduces carbon-containing solid onto said grid and further comprising means for introducing offgas from the pretreater section into the gasifier section which offgas introducing means comprises means for providing communication between a portion of said pretreater section and said grid of said gasifier.

5. The apparatus of claim 4 wherein said gasifier section comprises a bed of pretreated carbon-containing solids and said offgas is introduced at the bottom of the bed of the gasifier section.

6. The apparatus of claim 1 wherein said pretreater section and said gasifier section are defined by an integral and unitary vessel and wherein said gasifier section is located above said pretreater section.

7. The apparatus of claim 1 wherein said means for introducing pretreated carbon-containing solid into the gasifier section comprises means for introducing steam into said lift pipe to urge carbon-containing solid up said lift pipe into said gasifier section.

8. The apparatus of claim 1 comprising means for introducing steam for said gasifier section initially into said pretreater section.

9. The apparatus of claim 6 wherein said grid allows offgas from the pretreater section to be substantially evenly distributed to the base of the gasifier section.

10. The apparatus of claim 1 wherein said flow regulation means comprise means for measuring the differential pressure between a point in carbon-containing solid in the pretreater section and a point above carbon-containing solid in the pretreater section.

11. A method for gasifying carbon-containing solid in a single vessel comprising a pretreater section and a gasifier section arranged substantially vertically over said pretreater with a grid between said sections, said method comprising the steps of:

introducing carbon-containing solid into a pretreater section of a gasifier;

introducing an oxygen-containing gas into the pretreater section to pretreat carbon-containing solid;

introducing gases from said pretreater to said gasifier through said grid;

lifting pretreated carbon-containing solid from the pretreater section into the gasifier section through a lift pipe which is located within said single vessel and which extends from the bed of solids in the pretreater into said gasifier section; and regulating the rate of flow of carbon-containing solid from the pretreater section into the gasifier section in order to selectively control the residence time of carbon-containing solid in the pretreater section.

12. The method of claim 1 wherein said lifting step includes the step of fluidizing carbon-containing solid to decrease the bulk density of pretreated carbon-containing solid.

13. The method of claim 12 comprising the step of using a gas to fluidize pretreated carbon-containing solid.

14. The method of claim 13 comprising the step of:

introducing the gas into the lift pipe to decrease the density of carbon-containing solid in said pipe.

15. The method of claim 11 comprising the step of:

selectively introducing steam into the pretreater section to cool carbon-containing solid in the pretreater section.

16. The gasifier of claim 1 wherein said means for introducing an oxygen-containing gas into the pretreater section comprises means for fluidizing carbon-containing solid in said pretreater section.

17. The method of claim 11 comprising the step of:

maintaining carbon-containing solid in the pretreater section in a fluidized state.

18. The apparatus of claim 1 comprising means for creating a higher temperature zone in said gasifier section to soften and agglomerate ash.

19. The apparatus of claim 18 wherein said high temperature zone means comprises means for introducing oxygen-containing gas into the gasifier section.

20. The apparatus of claim 14 wherein said high temperature zone means comprises a venturi means for increasing the speed of the oxygen-containing gas introduced to the gasifier section.

21. The method of claim 11 comprising the step of:

creating a high temperature zone in said gasifier section to soften and agglomerate ash.

22. The method of claim 21 wherein the step of creating a high temperature zone comprises the step of:

introducing oxygen-containing gas into the gasifier section.

23. The method of claim 22 comprising the step of:

increasing the speed of the oxygen-containing gas in the high temperature zone.

* * * * *